US009970734B2

(12) United States Patent
Burke

(10) Patent No.: US 9,970,734 B2
(45) Date of Patent: May 15, 2018

(54) BREACH THREAD PROTECTOR

(71) Applicant: Paul A. Burke, Eldersburg, MD (US)

(72) Inventor: Paul A. Burke, Eldersburg, MD (US)

( * ) Notice: Subject to any disclaimer, the term of this patent is extended or adjusted under 35 U.S.C. 154(b) by 0 days. days.

(21) Appl. No.: 15/658,783

(22) Filed: Jul. 25, 2017

(65) Prior Publication Data

US 2018/0058803 A1 Mar. 1, 2018

Related U.S. Application Data

(62) Division of application No. 14/668,306, filed on Mar. 25, 2015, now Pat. No. 9,759,514.

(60) Provisional application No. 61/970,687, filed on Mar. 26, 2014.

(51) Int. Cl.

| | |
|---|---|
| ***F41A 29/00*** | (2006.01) |
| ***F41C 9/08*** | (2006.01) |
| ***B08B 9/00*** | (2006.01) |

(52) U.S. Cl.
CPC ..... *F41C 9/08* (2013.01); *B08B 9/00* (2013.01); *F41A 29/00* (2013.01)

(58) Field of Classification Search
None
See application file for complete search history.

(56) References Cited

U.S. PATENT DOCUMENTS 2,116,392 A 5/1938 Grasser

*Primary Examiner* — Mikhail Kornakov
*Assistant Examiner* — Ryan L. Coleman
(74) *Attorney, Agent, or Firm* — Sughrue Mion, PLLC

(57) ABSTRACT

The present invention is related to a breech thread protector for cleaning bore of a firearm from breech area of the barrel to the muzzle of the barrel. The breech thread protector includes an elongated tubular member having a proximal open end and a distal open end. The invention is also related to an assembly including the breech thread protector, a kit for cleaning the bore of the barrel, and a method for cleaning bore of the barrel.

11 Claims, 2 Drawing Sheets

BREACH THREAD PROTECTOR

This application is a Divisional of U.S. application Ser. No. 14/668,306, filed Mar. 25, 2015 (now allowed); which claims benefit of Provisional Application No. 61/970,687, filed Mar. 26, 2014; the contents of all of which are incorporated herein by reference in their entirety.

FIELD OF THE INVENTION

The present invention is related to a breech thread protector, an assembly including the protector, a kit including the protector, and methods for cleaning the bore of a firearm.

BACKGROUND OF THE INVENTION

When discharged, various substances produced during combustion of gun powder and ammunition adhere to inner surface of the gun barrel. Deposits inside the gun barrel can lower the accuracy of the gun and lead to corrosion inside the barrel. Accordingly, after the gun barrel is used, the substances stuck on the inside of the gun barrel need to be removed.

Typically, disassembly, cleaning, and lubrication of the gun is time consuming. The gun barrel is often cleaned using a brush fixed to an end part of a rod, and by repetitive pushing/pulling of the rod into/from the gun barrel. This action removes substances remaining in the gun barrel after firing. However, the dislodged material can deposit in certain areas of the gun barrel such as the threads present in the breech area of a firearm.

Modern muzzle loading firearms have been refined to allow an "in line" design. The side lock had been replaced with a primer or other detonation/ignition device that is located directly behind the powder charge. To facilitate cleaning and maintenance, the rear portion of the barreled action is removable. This removable portion is called a removable breech plug. The removable breech plug attaches to the breech area of the firearm.

The removable breech plug is secured and removed by various thread designs. Some are screwed into place with standard type threading. Other threading designs also exist and more designs may be developed in the future. A "quarter turn" design is one such example. Regardless of the mechanism for securing or removing the breech plug, the reason for removing it remains the same, to facilitate thorough cleaning of the firearm.

When a breech plug is removed from a firearm, it allows a person to clean the barrel from one end of the barrel completely through to the other end of the barrel. As cleaning devices, brushes, patches, solvents, lubricants, and preservatives are pushed through the barrel during cleaning, they tend to deposit debris such as products of combustion, remnants of the cleaning solvent, and lubricating agents in the threads which secure the breech plug to the breech area of the firearm.

Such contaminants are often difficult to remove from the threads of the breech area and require additional care and time. If not removed carefully, the debris can cause the breech plug to not seat properly. The debris can also cause corrosion of the barrel. If this occurs, the breech plug may either not install properly, or if installed, may become lodged and difficult to remove without damage to the plug or the barrel.

The present invention is directed to overcoming these and other deficiencies in the art.

SUMMARY OF THE INVENTION

In a first aspect the present invention is related to a breech thread protector for cleaning bore of a firearm from breech area of barrel to muzzle of the barrel. The breech thread protector includes an elongated tubular member having a proximal open end, an open passage, and a distal open end. The tubular member is adapted for or capable of aligning with the barrel such that the tubular member forms an open communicating passage with the barrel. The distal end of the tubular member has threads adapted for or capable of coupling with threads inside the breech area of the gun barrel and the proximal end of the elongated tubular member has an outer diameter that is equal to or larger than outer diameter of the distal end of the tubular member.

A second aspect of the invention is related to an assembly for cleaning bore of a barrel from breech area of the barrel to muzzle of the barrel. The assembly includes a) the elongated tubular member according to the first aspect of the invention, b) a barrel of a firearm comprising a breech area having threads and a muzzle. The elongated tubular member is coupled to the breech area of the barrel such that the tubular member is aligned with the barrel in a way that the barrel and the open passage of the tubular member form an open communicating passage from the muzzle of the barrel to the proximal end of the tubular member.

A third another aspect of the present invention is related to a method of cleaning bore of a firearm from breech area of barrel to muzzle of the barrel. The method includes coupling the distal end of the breech thread protector, according to the first aspect of this invention, to a barrel of a firearm. The barrel includes a breech area having threads and a muzzle such that the threads of the breech area are substantially covered by the distal end of the breech thread protector. The method also includes a step of cleaning the bore of the firearm such that debris inside the barrel is not deposited on or inside the threads inside the breech area of the barrel.

A fourth aspect of the present invention is related to a kit that includes the breech thread protector according to the first aspect of the present invention.

BRIEF DESCRIPTION OF THE DRAWINGS

FIG. 2A shows a cross-section of the breech thread protector along line 2A-2A in FIG. 1. FIG. 2B shows a cross-section of the breech thread protector along line 2B-2B in FIG. 1. FIG. 2C shows a cross-section of the breech thread protector along line 2C-2C in FIG. 1.

DETAILED DESCRIPTION OF THE INVENTION

It is a feature of the present invention to provide a device for cleaning a gun barrel that is adapted for or able of protecting the threads present in the breech area of the gun barrel such that debris, e.g., products of combustion, remnants of cleaning solvent, lubricating agents, and the like are not deposited in the threads of the breech area during cleaning. It is also a feature of the invention to provide a device for cleaning a gun barrel that is structurally strong, compact, and allows for easy manipulation, including coupling and decoupling of the breech thread protector to the gun barrel.

In a first aspect the present invention is related to a breech thread protector for cleaning bore of a firearm from breech area of barrel to muzzle of the barrel. The breech thread protector includes an elongated tubular member having a proximal open end, an open passage, and a distal open end. The tubular member is adapted for or capable of aligning with the barrel such that the tubular member forms an open communicating passage with the barrel. The distal end of the tubular member has threads adapted for or capable of coupling with threads inside the breech area of the gun barrel and the proximal end of the elongated tubular member has an outer diameter that is equal to or larger than outer diameter of the distal end of the tubular member.

The firearms of the present invention have a barrel that has a breech end and a muzzle end. The firearms also include a removable breech plug.

The breech plug is removable to facilitate pass-through cleaning of the barrel of the gun. Often removable breech plugs employ a finely threaded body that screws into the rear of the barrel, with 10-15 turns to secure it in place. This provides safety against hang fires and facilitates removal for cleaning. However, cleaning of the threads present in the breech area requires significant undesirable time and effort. Moreover, the fouling associated with combustion can clog the threads, requiring undesirably great torque to remove the plug.

The breech thread protector of the present invention is adapted for or capable of removably coupling with the breech end of the firearm. In particular, the distal open end of the breech thread protector removably couples with the breech end of the firearm and faces the breech end of the firearm during assembly. The proximal open end of the breech thread protector faces away from the breech end of the firearm during assembly and may be used to hold the breech thread protector.

Figure 1:
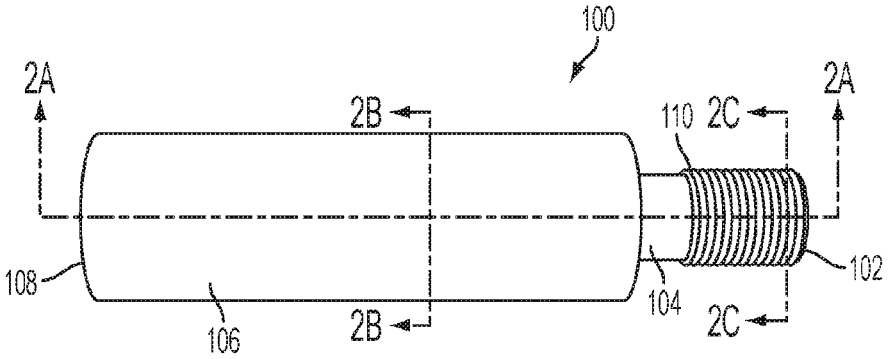
FIG. 1 is shows a side view of the breech thread protector according to one embodiment of the present invention.

FIG. 1 shows an exemplary breech thread protector of the present invention. It has an elongated tubular member 100 that has a distal open end 102, a proximal open end 106, and a neck 104 that connects distal end 102 to proximal end 106. There is an open passage 108 inside the tubular member 100 that runs through the distal end 102, the neck 104, and the proximal end 106. This open passage 108 aligns with the bore of the barrel of the gun when the breech thread protector is coupled with the barrel and forms an open communicating passage.

Upon assembly, the open passage 108 inside the tubular member 100 is in communication with the barrel of the gun and forms an open communicating passage from the muzzle of the gun to the proximal end of the breech thread protector. The distal end 102 has threads 110 on its surface such that the threads are adapted for or capable of coupling with the threads inside the breech area of the gun.

In one embodiment the breech thread protector of e present invention is such that the outer diameter of the distal end of the tubular member matches the caliber of the gun. For example, in FIG. 1 the outer diameter of the distal end 102 is such that the distal end can be inserted inside the breach area of the barrel because the outer diameter of the distal end matches the caliber of the gun.

Additionally, the outer diameter of the distal end can be designed such that the distal open end is adapted for or capable of coupling with guns of different calibers. In one embodiment, the breech thread protector of the present invention has multiple distal ends that are adapted for or capable of coupling with guns of different calibers.

The threads on the distal end of the tubular member are adapted for or capable of coupling with threads inside the breech area of the gun. The threads can couple with all or a portion of the threads inside the breech area. In a preferred embodiment, the threads on the distal open end are adapted for capable of coupling with a substantial portion of threads inside the breech area of the gun. Moreover, the distal open end can be designed such that it has male threads adapted for or capable of coupling threads inside the breech area.

In one embodiment, the threads on the distal open end are a replica of the threads present on the breech plug that is adapted for or capable of attaching to the breech area of the gun. This allows for easy coupling of the breech thread protector to the breech area of the barrel.

The internal diameter of the tubular member can be such that it matches, i.e., is substantially similar, to the caliber of gun. For example, the internal diameter of open passage 108, in FIG. 1, is the same as the caliber of the gun. In some embodiments, the internal diameter of the open passage 108 can be enlarged to allow a brush or other cleaning device to change directions and be moved forward and back to facilitate cleaning.

The proximal end of the tubular member can have an outer diameter that is larger than the outer diameter of the distal end of the tubular member. As shown in FIG. 1, the proximal open end 106 has an outer diameter that is larger than the outer diameter of the distal end 102. This allows for, e.g., easy handling of the breech thread protector.

Figure 2A:
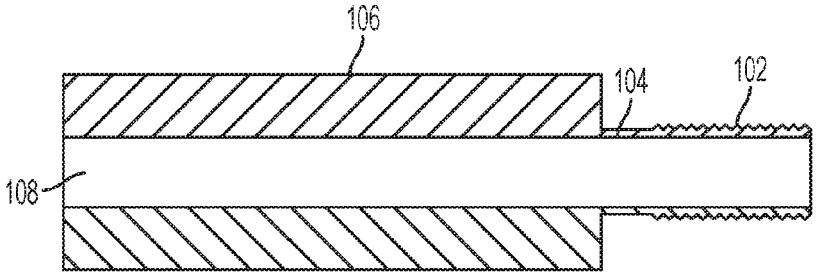
FIGS. 2A-C show various cross-sections of the exemplary breech thread protector shown in FIG. 1.

A person of ordinary skill in the art would know that the outer surface and outer diameter of the proximal open end can be easily designed or configured such that it is suitable for manipulation by humans. The outer surface of the proximal end is useful for holding the breech thread protector and for application of torque in order to couple the protector to the gun. In FIG. 2A, the outer diameter of the proximal end 106 is larger than the outer diameter of the distal open end 102. This allows for easy manipulation of the breech protector, adds strength to the device, and allows for easy application of torque necessary to couple the protector to the gun.

Figure 2B:
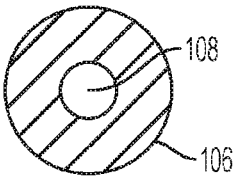
Figure 2C:
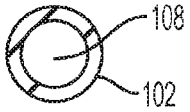

FIGS. 2B and 2C show one embodiment present n where the outer diameter of the proximal end 106 is larger than the outer diameter of distal end 102. The inner diameter of the open passage 108 is the same in both FIGS. 2B and 2C.

The proximal open end of the breech thread protector can be elongated. This allows the user to easily hold the breech thread protector during assembly and apply the torque necessary for assembly.

Also, when the outer diameter of the proximal open end 106 is larger than the outer diameter of the distal end 102, the proximal open end has a sidewall facing the breech area of the gun. This side wall can sit flush with the gun when the breech thread protector is coupled to the barrel. The abutment of the sidewall with the gun barrel prevents the breech thread protector from moving sideways or wiggling during cleaning.

Figure 3:
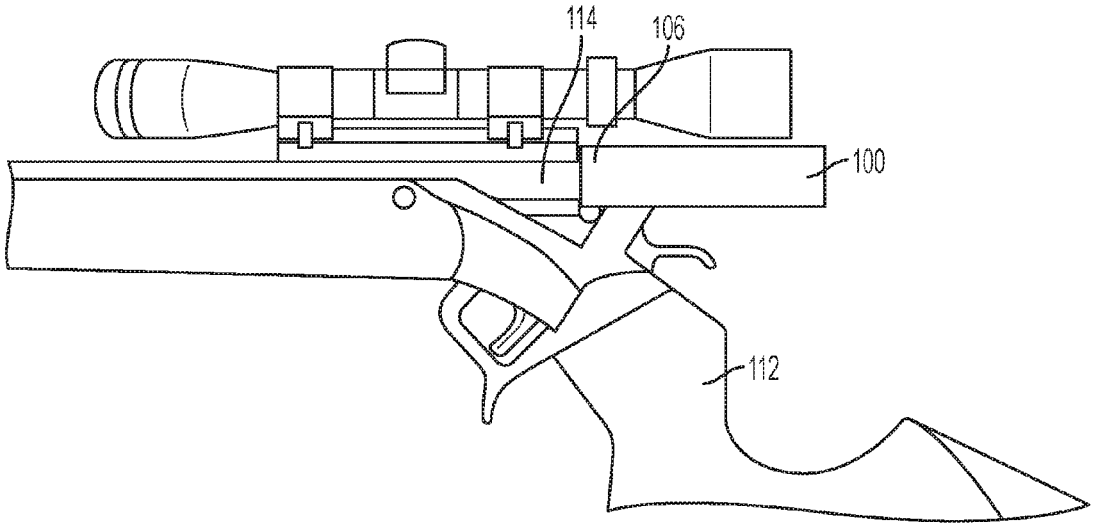
FIG. 3 shows an exemplary assembly according to the present invention which includes the breech thread protector and a barrel of a firearm. The firearm is in an open configuration such that the breech area of the firearm is exposed.

For example, in FIG. 3, the breech protector 100 is coupled to a gun 112. The barrel 114 of the gun is coupled to the breech protector 100 and the proximal end 106 of the protector 100 has an outer diameter that is larger than the outer diameter of the distal end of the breech protector. In FIG. 3, the distal end 102 of the protector 100 is hidden from view because it is inside the barrel 114. The sidewall of proximal end 106 faces the breech area of the gun barrel upon coupling. As seen in FIG. 3, the sidewall of the proximal end is seated flush against the breech end of gun.

In another embodiment, the breech thread protector of the present invention further comprises a tubular neck connecting the distal end to the proximal end of the tubular member. The tubular neck can have an outer diameter that is less than or equal to the outer diameter of the distal end of the tubular member. For example, in FIG. 1, the neck 104 has an outer diameter that is smaller than both the distal end 102 and the proximal end 106. The passage 108 is running from the distal end 102 through the neck portion 104 and to the proximal end 108. The passage 108 can have the same internal diameter all through the breech protector or it can have different diameters in each portion of the breech thread protector. In a preferred embodiment, the internal diameter of the neck matches the caliber gun. That is to say that the internal diameter of the neck is substantially similar to the caliber of the gun.

A second aspect of the invention is related to an assembly for cleaning bore of a barrel from breech area of the barrel to muzzle of the barrel. The assembly includes a) the elongated tubular member according to the first aspect of the invention, b) a barrel of a firearm comprising a breech area having threads and a muzzle. The elongated tubular member is coupled to the breech area of the barrel such that the tubular member is aligned with the barrel in a way that the barrel and the open passage of the tubular member form an open communicating passage from the muzzle of the barrel to the proximal end of the tubular member.

One embodiment of such assembly is shown in FIG. 2. The elongated tubular member 100 is coupled to a barrel 114 such that the open passage 108 inside the tubular member 100 is aligned with the bore of barrel 114. The bore of barrel 114 and open passage 108 form an open communicating passage from the muzzle of barrel 114 to the proximal end of the tubular member 100.

During cleaning, this open communicating passage allows debris to travel inside the open communicating passage and fall out from the open proximal end of the tubular member 100 or from the muzzle of the gun. As the threads of the breech area of the gun are covered by the breech thread protector, the debris is less likely to deposit in or over the threads inside the breech area of the gun.

During cleaning, the cleaning apparatus, such as a brush, can be inserted from the open proximal end of the tubular member 100. Alternatively, the brush can be inserted from the muzzle of the gun. The open communicating passage from the muzzle of the barrel to the proximal open end of the breech thread protector allows the cleaning brush to easily negotiate through the barrel as well as the breech thread protector during cleaning.

In one embodiment, the assembly according to the second aspect to the present invention includes a barrel that is detached from a breech-loading firearm. This allows for easy handling of the barrel during cleaning. In another embodiment, the assembly of the present invention is such that the barrel is still attached to the firearm.

A third another aspect of the present invention is related to a method of cleaning bore of a firearm from breech area of the barrel to the muzzle of the barrel. The method includes a step of coupling the distal open end of the breech thread protector, according to the first aspect of this invention, to the barrel of a firearm. The barrel includes a breech area having threads and a muzzle. The breech thread protector is coupled to the barrel such that the threads of the breech area of the gun are substantially covered by the distal open end of the breech thread protector. The method also includes a step of cleaning the bore of the firearm such that debris inside the barrel is not deposited on or inside the threads present in the breech area of the gun.

In one embodiment, the method further includes a step of applying cleaning agents, cleaning brush, solvents or preservatives to the barrel.

The coupling step of the method according to the present invention may include a step of adjusting the breech thread protector such that a portion of the proximal end of the tubular member is seated substantially flush with the breech area of the barrel. For example, in FIG. 3, a sidewall of proximal open end 106 faces the breech end of the gun upon coupling. The breech thread protector can be adjusted such that the sidewall of the proximal open end is seated flush against the breech end of barrel. This prevents sideways motion of the breech thread protector when coupled to the gun.

The breech thread protector of the present invention can be made of a material that is resistant to cleaning agents, solvents, preservatives or products of combustion. In a preferred embodiment, the protector of the present invention is made up of plastic or metal or a combination thereof. However, those skilled in the art will readily recognize that numerous other materials can be used to make the present invention. Accordingly, use of other materials, for making the breech thread protector, falls within the spirit and scope of the present invention.

The breech thread protector of the present invention provides a convenient way to clean a firearm. It is an economical and easily operated device that may be used for gun cleaning. It can be used with various other cleaning articles, such as lubricants and cleaning solution, without any danger of contaminating or fouling the breech area of the firearm. The device can be employed in the field, providing efficient barrel cleaning even under adverse conditions such as, sand, mud, or snow.

Moreover, the breech thread protector of the invention can be provided as part of a kit including cleaning materials such as lubricants and cleaning solutions. According to a fourth aspect, the present invention is related to a kit that includes the breech thread protector of the present invention.

With respect to the above description, it is to be realized that the optimum dimensional relationship for the various components of the present invention, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the present invention.

Moreover, in view of the disclosure of the present invention a person of skill in the art can design or manufacture breech thread protectors with specifications that match the calibers and threads of current and future firearms. The thread patterns can be designed to match the pattern of breech plug thread pattern of all in line muzzle loading firearms currently available as well as those that may be manufactured in the future. It may also be used to facilitate cleaning of recoilless rifles and cannons as used in artillery, aviation and other military applications.

Although preferred embodiments have been depicted and described in detail herein, it will be apparent to those skilled in the relevant art that various modifications, additions, substitutions, and the like can be made without departing from the spirit of the invention and these are therefore considered to be within the scope of the invention as defined in the claims which follow.

What is claimed is:

1. A system for cleaning a gun barrel's bore, comprising:

a gun comprising a barrel having a bore, wherein the barrel comprises a breach area, wherein the breach area comprises threads, and wherein the threads allow a breech plug to be removably attached to the breach area;

a breach thread protector comprising an elongated tubular member having a proximal open end, an open passage, and a distal open end wherein the tubular member is adapted for aligning with the barrel such that the tubular member forms an open communicating passage with the barrel;

wherein the distal end of the tubular member has threads adapted for coupling with the threads of the breech area such that the threads of the breach area can be substantially covered by the distal end when the distal end is coupled to the threads of the breech area; and wherein the proximal end of the elongated tubular member has an outer diameter that is equal to or larger than an outer diameter of the distal end of the tubular member.

2. The system according to claim 1 wherein the outer diameter of the distal open end matches a caliber of the gun.

3. The system according to claim 2 wherein the internal diameter of the open passage matches the caliber of the gun.

4. The system according to claim 1 wherein the threads of the distal end of the tubular member are adapted for coupling with a substantial number of the threads of the breech area of the barrel.

5. The system according to claim 1 wherein the distal end of the tubular member has male threads adapted for coupling the threads of the breech area.

6. The system according to claim 1 further comprising a tubular neck connecting the distal end to the proximal end, wherein the neck has an outer diameter that is less than or equal to the outer diameter of the distal end of the tubular member.

7. The system according to claim 6 wherein the internal diameter of the neck matches a caliber of the bore of the barrel.

8. The system according to claim 1 wherein the protector is made of a material that is resistant to cleaning agents, solvents, preservatives or products of combustion.

9. The system according to claim 8 wherein the protector is made of plastic or metal or a combination thereof.

10. The system according to claim 1 wherein the proximal end of the tubular member is configured such that a portion of the proximal end is adapted for seating substantially flush to the breech area upon coupling the breech thread protector to breech area.

11. The system according to claim 1, further comprising a cleaning solution for cleaning the bore of the gun.

* * * * *